US006003953A

United States Patent [19]

Huang et al.

[11] Patent Number: 6,003,953

[45] Date of Patent: Dec. 21, 1999

[54] CUTTER HEAD WITH CUTTING MEMBERS THAT ROTATE RELATIVE TO EACH OTHER

[76] Inventors: Chia-Hsiung Huang, 3 Fl. No. 22, Lane 89, Ku-Ling Street; Jyun-Hua Chiang, No. 21, Lane 22, Hsin-Min Road, both of Taipei, Taiwan

[21] Appl. No.: 09/072,391

[22] Filed: May 4, 1998

[30] Foreign Application Priority Data

Oct. 15, 1997 [TW] Taiwan ..... 86115109

[51] Int. Cl.[6] ..... E21C 25/06

[52] U.S. Cl. ..... 299/85.1; 299/59; 299/60

[58] Field of Search ..... 299/85.1, 60, 59, 299/33, 55, 56, 64, 68; 405/143

[56] References Cited

U.S. PATENT DOCUMENTS 3,064,958 11/1962 Osgood ..... 299/60

4,627,501 12/1986 Ebeling ..... 299/85.1 X

FOREIGN PATENT DOCUMENTS 1053487 1/1967 United Kingdom ..... 299/60

*Primary Examiner*—David Bagnell
*Assistant Examiner*—Sunil Singh
*Attorney, Agent, or Firm*—Samuels, Gauthier & Stevens

[57] ABSTRACT

A cutter head comprising a plurality of coaxially disposed transmission shafts including a central transmission shaft and at least two tubular transmission shafts with each shaft having a cutting member, the shafts being driven independently with one another and any two radially adjacent shafts being driven to rotate in opposite directions, wherein diameters of the shafts are determined in such a manner that a sum of cutting areas covered by the cutting members of the shafts rotating in one direction is substantially equal to a sum of the cutting areas covered by cutting members of the shafts rotating in the opposite direction.

4 Claims, 9 Drawing Sheets

CUTTER HEAD WITH CUTTING MEMBERS THAT ROTATE RELATIVE TO EACH OTHER

BACKGROUND OF THE INVENTION

1. Field of the Invention

The present invention relates to a cutter head, and particularly to a cutter head for a civil construction machine, such as a shield machine, a tunnel boring machine, a pipe-jacking drive shield machine, a casing drill and a roadheader, for excavating a tunnel, a pile hole, a caisson hole and the like.

2. Description of the Related Art

In a nowadays boring machine used in a civil construction for excavating a deep hole or a tunnel having a circular cross section or the like, the cutter head of the machine is usually driven by a motor through a transmission shaft in order to carry out a single-direction rotary cutting on the soil over the entire cross section of the cutter head. However, such an arrangement involves several problems.

First, the machine body must be capable of resisting the reaction transmitted thereto from the soil through the cutting head during the cutting operation in order to prevent the machine body from rotating, bouncing or even being spoiled. In addition, since the cutter head rotates in a single direction about its axis of rotation, for example, in the clockwise direction as viewed toward the advancing direction of the cutter head, the excavated tunnel or hole inevitably gradually deviates from the predetermined route toward the right.

The solutions to the aforementioned problems have been none other than to increase the size and/or the weight of the machine in order to sustain the reaction produced during the cutting operation and to reduce the normal pressure exerted on the soil by the cutter head and/or decrease the rotating speed of the cutter head in order to minimize the deviation of the excavated tunnel or hole from the predetermined route.

However, while by taking the above measures it may be possible to solve the aforementioned prior art problems to a certain degree, the cost is increased due to the larger size and heavier weight of the machine and the cutting efficiency is lowered due to the smaller normal pressure exerted by the cutter head and the smaller rotating speed of the cutter head.

Moreover, with a conventional cutter head, since a single-direction rotary cutting over the entire cross section of the cutter head is performed on the soil, when the cutter head encounters a large single stone or the like, it is more often than not that the large single stone is inlaid onto and hence carried by the cutting head for rotation. Consequently, the cutter head stops advancing for excavating and the large stone carried by and rotating with the cutter head severely damages the soil surface previously cut.

SUMMARY OF THE INVENTION

Therefore, it is an object of the present invention to provide a cutter head with which a rotation reaction against the cutter head during the cutting operation is eliminated or at least minimized.

It is another object of the present invention to provide a cutter head with which it is possible to decrease a deviation of a tunnel or a hole excavated thereby from a predetermined route.

It is still another object of the present invention to provide a cutter head with which it is possible to prevent any large single stone encountered during the cutting of soil from inlaying onto the cutter head so that the advancement of the cutter head during the cutting operation is ensured.

It is observed that in order to drill a hole in an object with an electric drill, a force must be exerted to the drill body so that the drill bit can penetrate into the object. Otherwise, the drill bit would just grind the surface of the object, resulting in wear of the drill bit and heat generation without producing any drilling effect. In addition to the normal pressure exerted on the dill body toward the object to be drilled, it is necessary to exert a force for holding the drill body and keeping it steady in order to resist the reaction produced during the drilling operation; otherwise, the drill body would rotate. In view of the above phenomenon, it can be concluded that a considerably large rotation reaction is produced due to the drilling operation, and if this rotation reaction can be eliminated or at least minimized, the drilling efficiency can be increased.

It is also observed that a saw normally has a higher cutting efficiency than a knife. Furthermore, if two saws are aligned side by side and reciprocatingly moved in opposite directions, the cutting efficiency of such an arrangement is higher than that of using a single saw to cut twice. This phenomenon indicates that the cutting efficiency is strongly related to the arrangement of cutting members.

Therefore, according to the present invention, there is provided a cutter head comprising a fixed casing defining an axis of rotation; a plurality of transmission shafts including a central transmission shaft and at least two tubular transmission shafts, each shaft having a first end fixedly connected with a cutting member and a second end; means for rotatably mounting the plurality of transmission shafts at the second ends thereof to the casing and to one another coaxially about the axis of rotation with one being disposed over an outer periphery of another; and means for driving the plurality of transmission shafts in such a manner that the shafts are driven independently with one another and any two radially adjacent shafts are driven to rotate in a first direction and a second direction which is opposite to the first direction with respect to the axis of rotation, wherein diameters of the plurality of transmission shafts are determined in such a manner that a sum of cutting areas covered by the cutting members of the shafts rotating in the first direction is substantially equal to a sum of cutting areas covered by the cutting members of the shafts rotating in the second direction.

DESCRIPTION OF THE PREFERRED EMBODIMENTS

Preferred embodiments of the invention will be described in detailed by making reference to the drawings.

Figure 1:
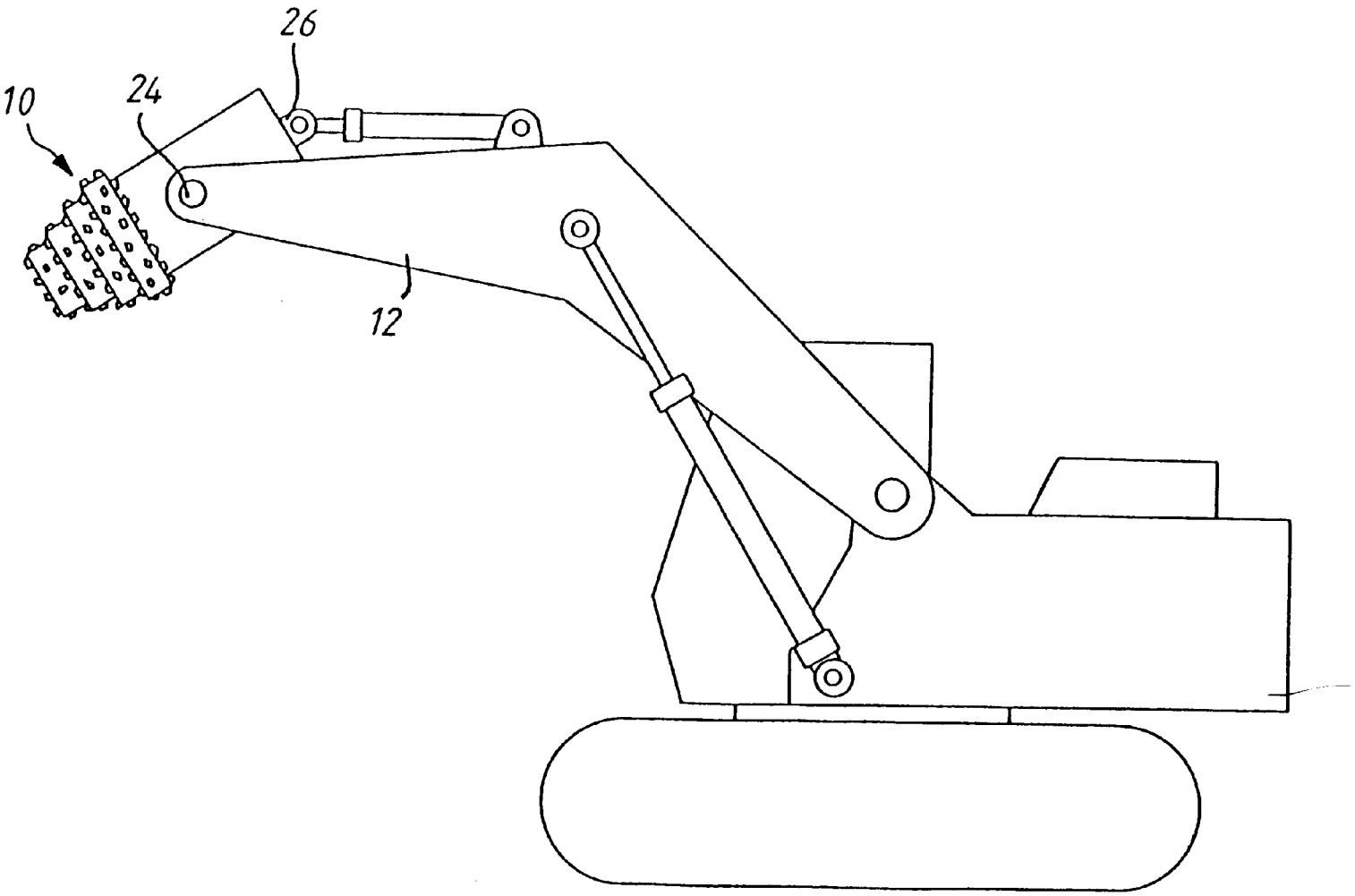
FIG. 1 shows a cutter head according to a first embodiment of the invention mounted to an arm of a shovel for cutting a reinforced concrete structure or a stony soil layer.
Figure 2:
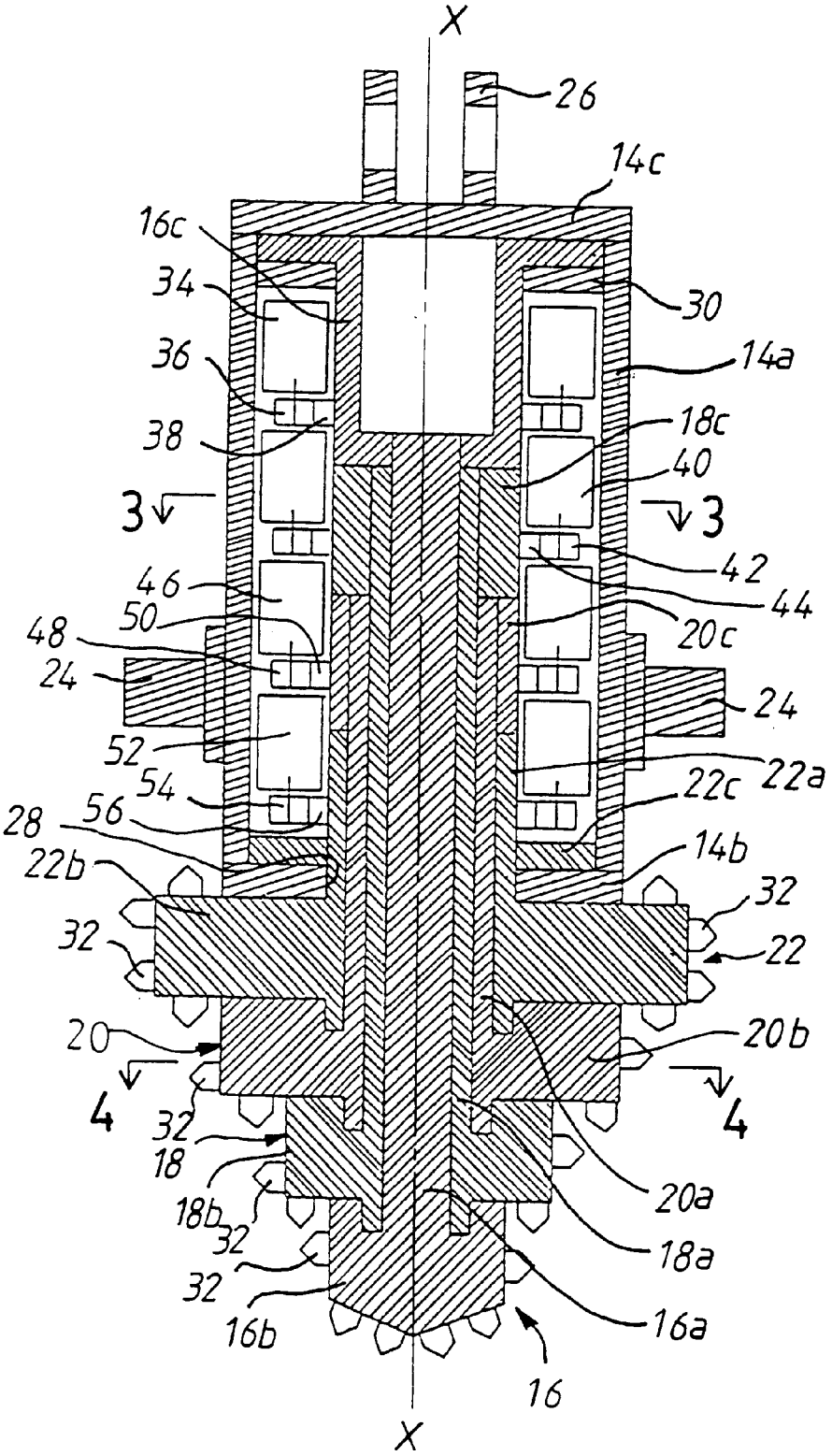
FIG. 2 is a longitudinal sectional view of the cutter head of FIG. 1.
Figure 3:
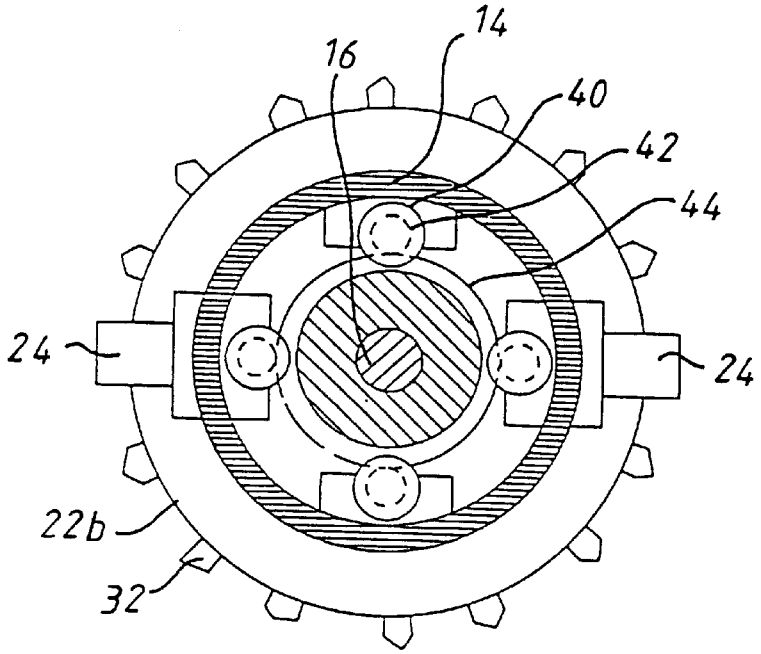
FIG. 3 is a cross sectional view taken along a line 3—3 in FIG. 2.
Figure 4:
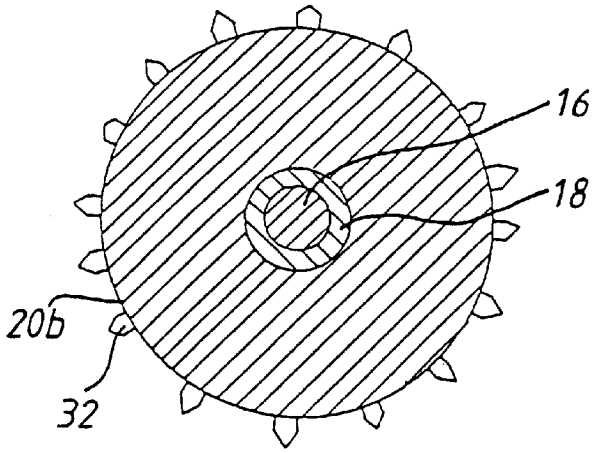
FIG. 4 is a cross sectional view taken along a line 4—4 in FIG. 2.

Referring to FIGS. 1 to 4, FIG. 1 shows a cutter head according to a first embodiment of the invention mounted to an arm of a shovel, FIG. 2 is a longitudinal sectional view of the cutter head of FIG. 1, and FIGS. 3 and 4 are cross sectional views taken along lines 3—3 and 4—4 in FIG. 2, respectively.

As shown in FIG. 1, a cutter head 10 according to the invention is mounted on a mechanical arm 12 of a shovel. The cutter head 10 is carried by the arm 12 to a desired level for cutting a reinforced concrete structure, a stony soil layer or the like.

As shown in FIGS. 2, 3 and 4, the cutter head 10 includes a cylindrical fixed casing 14 having a center axis X, a central transmission shaft 16, a first tubular transmission shaft 18, a second tubular transmission shaft 20 and a third tubular transmission shaft 22. The casing 14 has a main body 14*a*, a front cover 14*b* removably mounted at one end of the main body 14*a* and a rear cover 14*c* removably mounted at the other end of the main body 14*a*. A pair of diametrically opposite pivot shafts 24 are fixedly provided on the outer peripheral surface of the main body 14*a* of the casing 14 for connecting to the arm 12 of the shovel, and a pair of connecting ears 26 are integrally provided on the rear cover 14*c* of the casing 14 for connecting to a cylinder of the shovel. The front cover 14*b* of the casing 14 is provided with an opening 28 for receiving the shafts 16, 18, 20 and 22 coaxially about the center axis X.

The central transmission shaft (referred to as the central shaft hereinafter) 16 includes a main body 16*a*, a cutting member 16*b* integrally formed at one end of the main body 16*a* and a retainer portion 16*c* removably connected to the other end of the main body 16*a*. The central shaft 16 is received in the casing 14 with the retainer portion 16*c* thereof rotatably seated on an interior face of the rear cover 14*c* of the casing 14. As shown in FIG. 2, the central shaft 16 is prohibited from moving in the direction of the axis X relative to the casing 14 by a retainer ring 30 which is removably fixed to the casing 14 but is designed to allow the rotation of the central shaft 16 relative thereto. The cutting member 16*b* integrally formed at one end of the main body 16*a* of the central shaft 16 is a ring-shaped member and has a plurality of cutters 32 disposed on the peripheral surface and the end face thereof. Note that such cutters 32 as illustrated in the drawings are merely shown as an example and may be replaced by various types of picks, roller bits or the like depending on the intended application.

As shown in FIGS. 2 and 3, the central shaft 16 is driven for rotation by a set of four motors 34 mounted to the casing 14. Each of the motors 34 is provided with a driving gear 36 mounted to an output shaft thereof. The four driving gears 36 of the four motors 34 engage with a common ring gear 38 mounted around the peripheral surface of the retainer portion 16*c* of the central shaft 16. Thus, the central shaft 16 is independently driven for rotation by the motors 34 through the engagement of the ring gear 38 with the driving gears 36.

The first tubular transmission shaft (referred to as the first shaft hereinafter) 18 is coaxially disposed over the outer peripheral surface of the central shaft 16 about the axis X. The first shaft 18 includes a tubular main body 18*a*, a first cutting member 18*b* integrally formed at one end of the main body 18*a* and a retainer portion 18*c* removably mounted at the other end of the main body 18*a*. The retainer portion 18*c* serves to prohibit the first shaft 18 from moving in the direction of the axis X, yet it is designed to be mounted on the tubular main body 18*a* of the first shaft 18 in such a manner that it rotates with the tubular main body 18*a* and the first cutting member 18*b* as one piece. The first cutting member 18*b* of the first shaft 18 is also a ring-shaped member and has a plurality of cutters 32 disposed on the peripheral surface and the end face thereof.

Similar to the case of the central shaft 16, the first shaft 18 is driven for rotation by another set of four motors 40 mounted to the casing 14. Each of the motors 40 is provided with a driving gear 42 mounted to an output shaft thereof The four driving gears 42 of the four motors 40 engage with a common ring gear 44 mounted around the peripheral surface of the retainer portion 18*c* of the first shaft 18. Thus, the first shaft 18 is independently driven for rotation by the motors 40 through the engagement of the ring gear 44 with the driving gears 42.

Similarly, the second tubular transmission shaft (referred to as the second shaft hereinafter) 20 is coaxially disposed over the outer peripheral surface of the first shaft 18 about the axis X. The second shaft 20 includes a tubular main body 20*a*, a second cutting member 20*b* integrally formed at one end of the main body 20*a* and a retainer portion 20*c* removably mounted at the other end of the main body 20*a*. The retainer portion 20*c* of the second shaft 20 is the same as the retainer portion 18*c* of the first shaft 18 in terms of its structure and function. That is, the retainer portion 20*c* is designed to be mounted on the tubular main body 20*a* of the second shaft 20 in such a manner that it prohibits the second shaft 20 from moving in the direction of the axis X but it rotates with the tubular main body 20*a* and the second cutting member 20*b* as one piece. A plurality of cutters 32 are disposed on the peripheral surface and the end face of the ring-shaped second cutting member 20*b* of the second shaft 20.

Similar to the cases of the central shaft 16 and the first shaft 18, the second shaft 20 is driven for rotation by still another set of four motors 46 mounted to the casing 14. Each of the motors 46 is provided with a driving gear 48 mounted to an output shaft thereof. The four driving gears 48 of the four motors 46 engage with a common ring gear 50 mounted around the peripheral surface of the retainer portion 20*c* of the second shaft 20. Thus, the second shaft 20 is independently driven for rotation by the motors 46 through the engagement of the ring gear 50 with the driving gears 48.

The third tubular transmission shaft (referred to as the third shaft hereinafter) 22 is coaxially disposed over the outer peripheral surface of the second shaft 20 about the axis X. The third shaft 22 includes a tubular main body 22*a* having an outside diameter substantially equal to the diameter of the opening 28 of the front cover 14*b* of the casing 14, a third cutting member 22*b* integrally formed at one end of the main body 22*a* and a retainer portion 22*c* removably mounted to the tubular main body 22*a* for prohibiting the third shaft 22 from moving in the direction of the axis X yet rotating with the main body 22*a* and the third cutting member 22*b* as one piece. A plurality of cutters 32 are disposed on the peripheral surface and the front and back end faces of the ring-shaped third cutting member 22*b* of the third shaft 22.

Similarly, the third shaft 22 is independently driven for rotation by yet another set of four motors 52 mounted to the casing 14 through the engagement of a ring gear 56 mounted around the peripheral surface of the tubular main body 22*a* of the third shaft 22 with four driving gears 54 mounted to respective output shafts of the motors 52.

From the above, it is clear that the central shaft 16, the first shaft 18, the second shaft 20 and the third shaft 22 are driven for rotation independently from one another by respective sets of motors 34, 40, 46 and 52. Furthermore, according to the invention, it is arranged that any two radially adjacent shafts are driven for rotation in opposite directions with respect to the axis X. That is, if the central shaft 16 is driven for rotation, for example, in the counterclockwise direction with respect to the axis X as viewed from the cutting member 16*b* thereof, then the first shaft 18 is driven for rotation in the clockwise direction with respective to the axis X, and the second shaft 20 is driven to rotate in the counterclockwise direction while the third shaft 22 is driven to rotate in the clockwise direction. In addition, according to the invention, the dimensions of the shafts 16, 18, 20 and 22 and the respective cutting members 16*b*, 18*b*, 20*b* and 22*b* thereof are determined in such a manner that a sum of cutting areas covered by the cutting members of the shafts, for example, shafts 16 and 20, rotating in one direction is substantially equal to a sum of cutting areas covered by the cutting members of the shafts, for example, shafts 18 and 22, rotating in the opposite direction.

With the cutter head having the above structure, since any two radially adjacent cutting members are driven to rotate in opposite directions rather than having all of the cutting members driven to rotate in a single direction, the reactions produced due to the cutting carried out by the cutting members rotating in one direction and the cutting carried out by the cutting members rotating in the opposite direction substantially cancel with each other. Hence, the body of the cutter head is in a balanced state and the load sustained by the mechanical arm is reduced. As a result, a compact mechanical arm and shovel can be used.

In addition, since any two radially adjacent cutting members are driven to rotate in opposite directions, the cutting efficiency is improved and any large single stone or the like which may be encountered during the cutting is effectively cut without inlaying onto the cutter head.

Next, a cutter head according to a second embodiment of the invention will be described by making reference to FIGS. 5 to 12.

Figure 5:
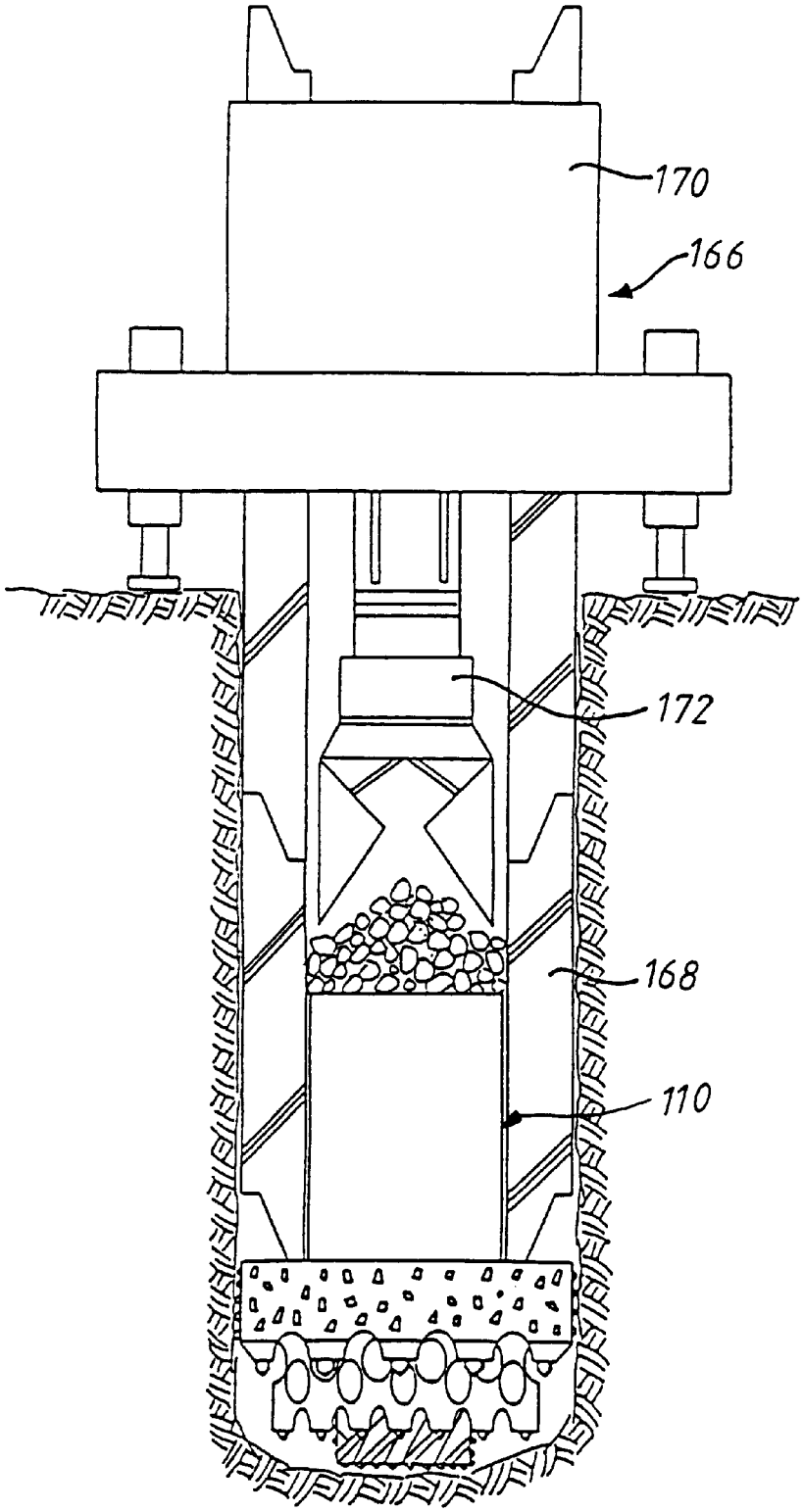
FIG. 5 shows a cutter head according to a second embodiment of the invention in an application of excavating in the vertical direction for the construction of, for example, piles, caissons or wells.
Figure 6:
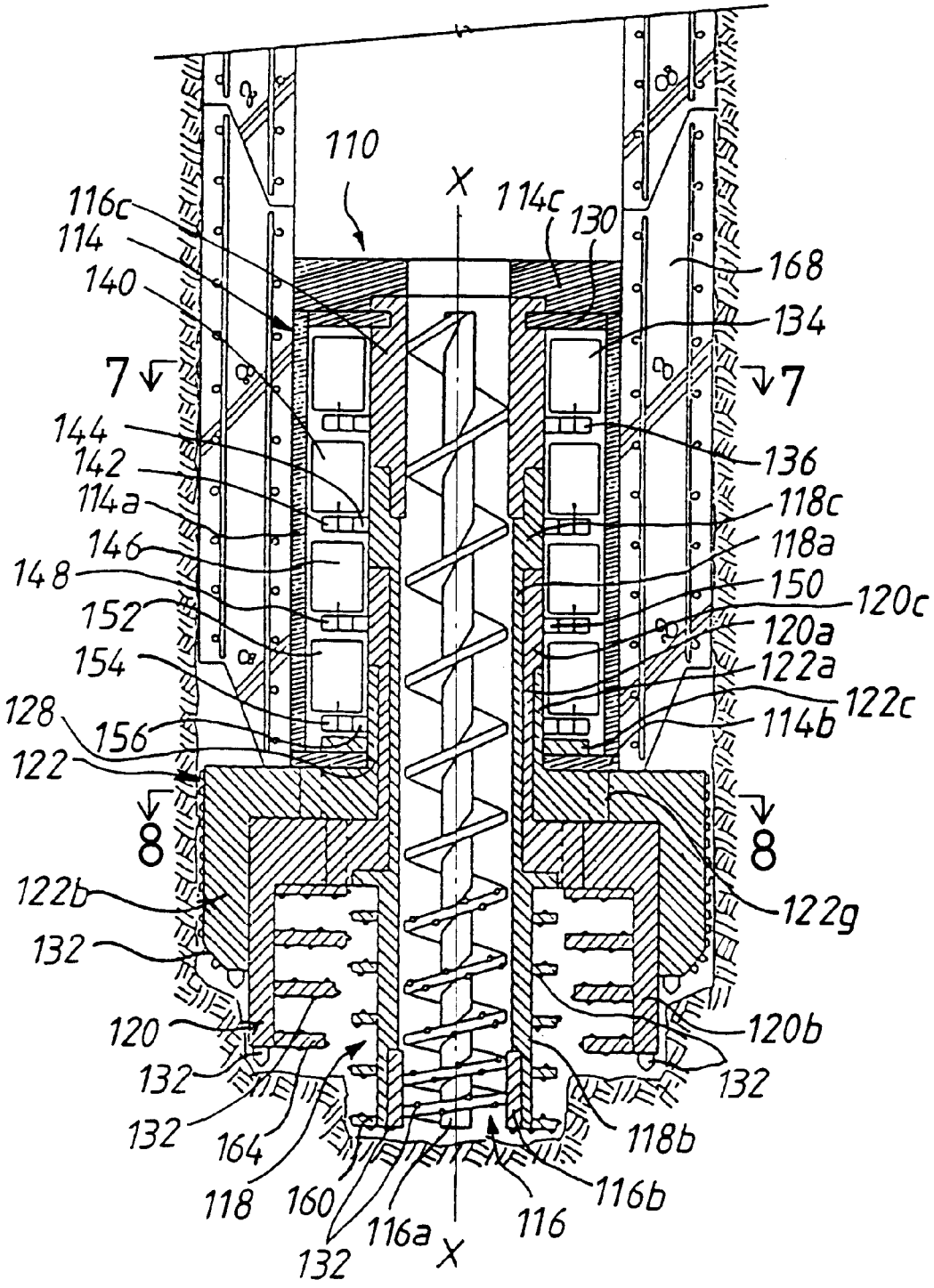
FIG. 6 is a longitudinal sectional view of the cutter head of FIG. 5.
Figure 7:
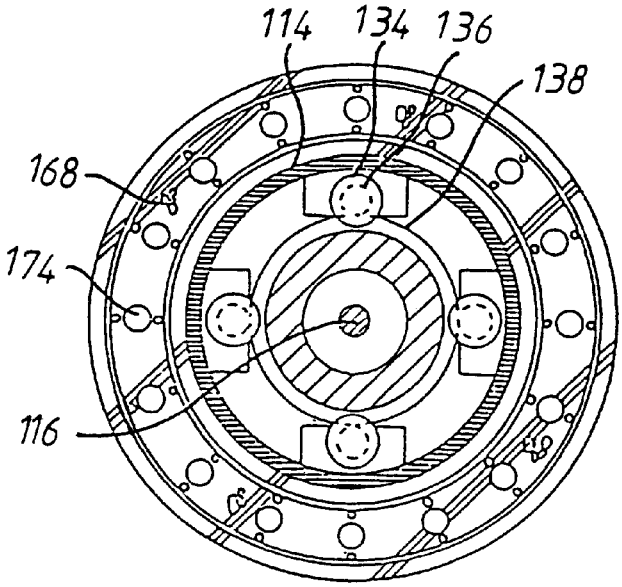
FIG. 7 is a cross sectional view taken along a line 7—7 in FIG. 6.
Figure 8:
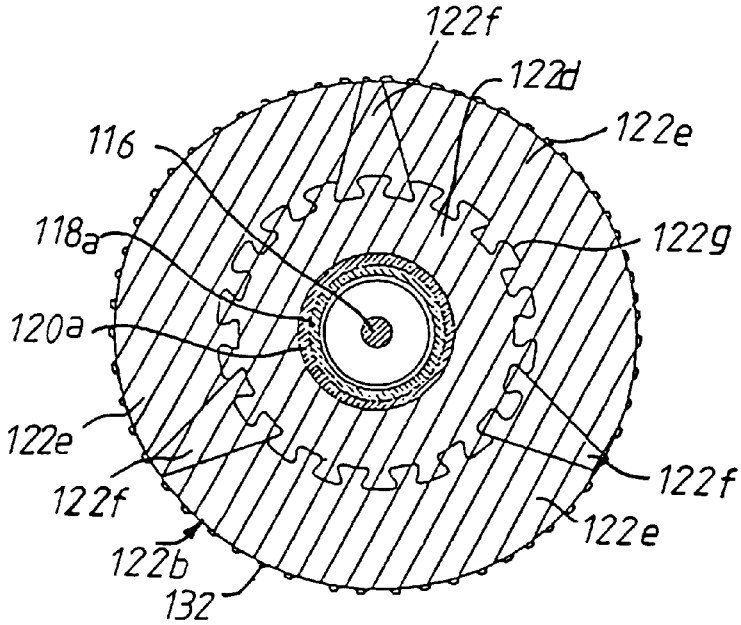
FIG. 8 is a cross sectional view taken along a line 8—8 in FIG. 6.
Figure 9:
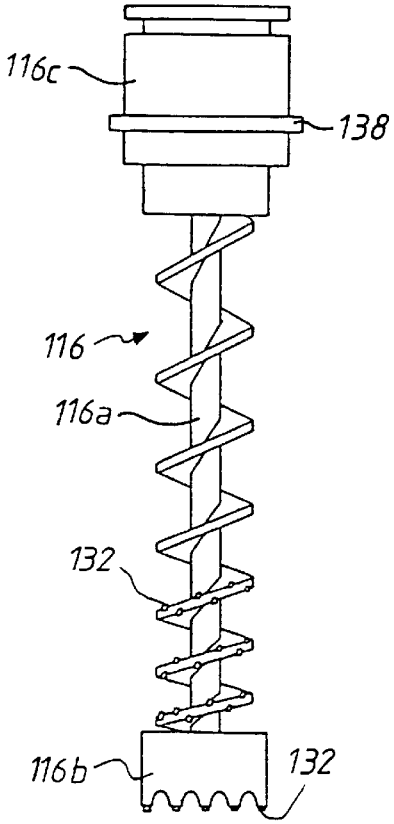
FIG. 9 shows a screw rod type transmission shaft and a cutting member thereof used in the cutter head of FIG. 6.
Figure 10:
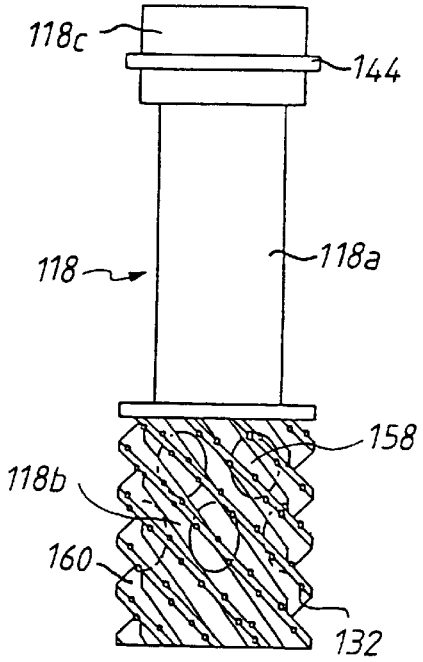
FIG. 10 shows a tubular transmission shaft and a cutting member thereof used in the cutter head of FIG. 6.
Figure 11:
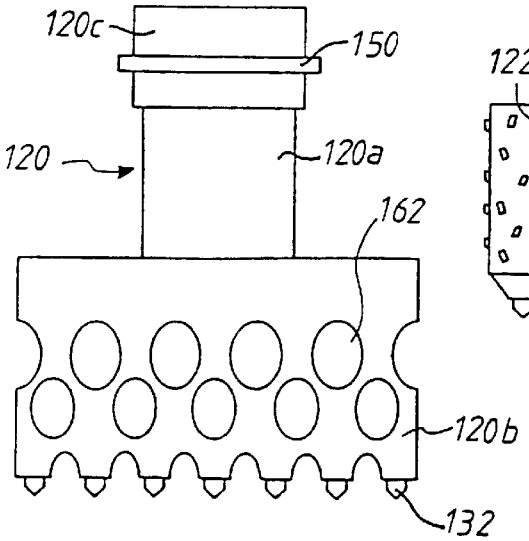
FIG. 11 shows another tubular transmission shaft and a cutting member thereof used in the cutter head of FIG. 6.
Figure 12:
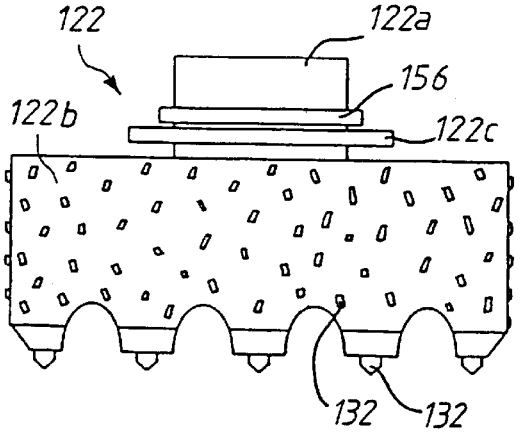
FIG. 12 shows still another tubular transmission shaft and a cutting member thereof used in the cutter head of FIG. 6.

FIG. 5 shows an arrangement in which a cutter head according to a second embodiment of the invention is applied for excavating in the vertical direction for the construction of piles, caissons or wells; FIG. 6 is a longitudinal sectional view of the cutter head of the invention used in the arrangement of FIG. 5; FIG. 7 is a cross sectional view taken along a line 7—7 in FIG. 6; FIG. 8 is a cross sectional view taken along a line 8—8 in FIG. 6; FIG. 9 shows a screw rod type transmission shaft and a cutting member thereof used in the cutter head of FIG. 6; and FIGS. 10 to 12 shows tubular transmission shafts and respective cutting members thereof used in the cutter head of FIG. 6.

As shown in FIGS. 6 to 8, the cutter head 110 according to the second embodiment of the invention includes a cylindrical fixed casing 114 having a center axis X, a central transmission shaft 116 having a portion 116*a* in the form of a screw rod, a first tubular transmission shaft 118, a second tubular transmission shaft 120 and a third tubular transmission shaft 122. The casing 114 has a main body 14*a*, a front cover 114*b* removably mounted at one end of the main body 114*a* and a rear cover 114*c* removably mounted at the other end of the main body 114*a*. The front cover 114*b* of the casing 114 is provided with an opening 128 for receiving the shafts 116, 118, 120 and 122 coaxially about the center axis X.

As shown in FIGS. 6 and 9, the central transmission shaft (referred to as the central shaft hereinafter) 116 includes the aforementioned screw rod portion 116*a*, a cutting member 116*b* fixedly attached to one end of the screw rod portion 116*a* and a retainer portion 116*c* connected to the other end of the screw rod portion 116*a*. The central shaft 116 is received in the casing 114 with the retainer portion 116*c* thereof rotatably in contact with an inner surface of the rear cover 114*c* of the casing 114. As shown in FIG. 6, the central shaft 116 is prohibited from moving in the direction of the axis X relative to the casing 114 by a retainer ring 130 which is removably fixed to the casing 114 but allows the rotation of the central shaft 116 relative thereto. The cutting member 116*b* is of a tubular shape fixedly connected to one end of the screw rod portion 116*a* of the central shaft 116 and having a plurality of cutters 132 disposed on the end face thereof. In addition, cutters 132 are also provided on part of the screw rod portion 116*a* near the cutting member 116*b*. Again, such cutters 132 as illustrated in the drawings are merely shown as an example and may be replaced by various types of roller bits or the like depending on the intended application.

As shown in FIGS. 6 and 7, the central shaft 116 is driven for rotation by a set of four motors 134 mounted to the casing 114. Each of the motors 134 is provided with a driving gear 136 mounted to an output shaft thereof The four driving gears 136 of the four motors 134 engage with a common ring gear 138 mounted around the outer peripheral surface of the retainer portion 116*c* of the central shaft 116. Thus, the central shaft 116 is independently driven for rotation by the motors 134 through the engagement of the ring gear 138 with the driving gears 136.

As shown in FIG. 6, the central shaft 116 is coaxially received in the first tubular transmission shaft (referred to as the first shaft hereinafter) 118 about the axis X. As shown in FIGS. 6 and 10, the first shaft 118 includes a tubular main body 118*a*, a first cutting member 118*b* integrally formed at one end of the main body 118*a* and a retainer portion 118*c* formed at the other end of the main body 118*a*. The retainer portion 118*c* also serves to prohibit the first shaft 118 from moving in the direction of the axis X. The first cutting member 118*b* of the first shaft 118 is of a tubular shape. The tubular cutting member 118*b* is provided with a plurality of openings 158 (FIG. 10) in the tube wall thereof and a plurality of helical cutting blades 160 disposed along and extending around the outer peripheral surface of the tube wall thereof. A plurality of cutters 132 are disposed on the end face of the tubular cutting member 118*b* and on the helical cutting blades 160.

Similar to the case of the central shaft 116, as shown in FIG. 6, the first shaft 118 is driven for rotation by another set of four motors 140 mounted to the casing 114. Each of the motors 140 is provided with a driving gear 142 mounted to an output shaft thereof The four driving gears 142 of the four motors 140 engage with a common ring gear 144 mounted around the peripheral surface of the retainer portion 118*c* of the first shaft 118. Thus, the first shaft 118 is independently driven for rotation by the motors 140 through the engagement of the ring gear 144 with the driving gears 142.

The second tubular transmission shaft (referred to as the second shaft hereinafter) 120 is coaxially disposed over the outer peripheral surface of the first shaft 118 about the axis X. As shown in FIGS. 6 and 11, the second shaft 120 includes a tubular main body 120*a*, a second cutting member 120*b* integrally formed at one end of the main body 120*a* and a retainer portion 120*c* formed at the other end of the main body 120*a*. The retainer portion 120*c* of the second shaft 120 serves to prohibit the second shaft 120 from moving in the direction of the axis X. The second cutting member 120*b* of the second shaft 120 is of a tubular shape. The tubular cutting member 120*b* is provided with a plurality of openings 162 in the tube wall thereof and a plurality of helical cutting blades 164 (FIG. 6) disposed along and extending around the inside peripheral surface of the tube wall thereof. A plurality of cutters 132 are disposed on the end face of the tubular cutting member 120*b* and on the helical cutting blades 164.

Similar to the cases of the central shaft 116 and the first shaft 118, as shown in FIG. 6, the second shaft 120 is driven for rotation by still another set of four motors 146 mounted to the casing 114. Each of the motors 146 is provided with a driving gear 148 mounted to an output shaft thereof The four driving gears 148 of the four motors 146 engage with a common ring gear 150 mounted around the peripheral surface of the retainer portion 120*c* of the second shaft 120. Thus, the second shaft 120 is independently driven for rotation by the motors 146 through the engagement of the ring gear 150 with the driving gears 148.

The third tubular transmission shaft (referred to as the third shaft hereinafter) 122 is coaxially disposed over the outer peripheral surface of the second shaft 120 about the axis X. As shown in FIGS. 6 and 12, the third shaft 122 includes a tubular main body 122*a* having an outside diameter substantially equal to the diameter of opening 128 of the casing 114, a third cutting member 122*b* integrally formed at one end of the main body 122*a* and a removable retainer portion 122*c* for prohibiting the third shaft 122 from moving in the direction of the axis X. The third cutting member 122*b* of the third shaft 122 is of a tubular shape. The tubular cutting member 122*b* is provided with a plurality of cutters 132 on the end face and the peripheral surface thereof.

In order to smoothly retreat the cutter head 110 after the completion of the excavation, the cutting member 122*b* of the third shaft 122 includes, as shown in FIG. 8, a first annular portion 122*d* and a second annular portion consisting of three arcuate segments 122*e* and three wedge blocks 122*f*. The first annular portion 122*d* is fixed connected to the third shaft 122. The three arcuate segments 122*e* are mounted over the outer periphery of the first annular portion 122*d* with a dovetail joint 122*g* therebetween so that the segments 122*e* are slidable when pushed in the direction of the axis X with respective to the first annular portion 122*d*. Each of the three wedge blocks 122*f* is located between two arcuate segments 122*e* and is also mounted over the outer periphery of the first annular portion 122*d* with the dovetail joint 122*g* therebetween. Thus, when the cutter head 110 is withdrawn, the first annular portion 122*d* moves together with the casing 114 and other parts of the cutter head 110, leaving the arcuate segments 122*e* and the wedge blocks 122*f* crumbling in the excavated hole (more description later), which can be picked up later. Of course, the number of the arcuate segments and the corresponding wedge blocks is not limited by three but may be changed as desired.

Similarly, the cutting member 120*b* of the second shaft 120 is also designed to include a first annular portion and a second annular portion consisting of three arcuate segments and three wedge blocks with the same engaging relationship among one another as that of the cutting member 122*b* of the third shaft 122 mentioned above. Thus, when the cutter head 110 is withdrawn, the first annular portion moves together with the casing 114 and other parts of the cutter head 110, leaving the arcuate segments and the wedge blocks crumbling in the excavated hole (more description later), which can be picked up later.

Again, the third shaft 122 is independently driven for rotation by yet another set of four motors 152 mounted to the casing 114 through the engagement of a ring gear 156 mounted around the peripheral surface of the third shaft 122 with four driving gears 154 mounted to respective output shafts of the motors 152.

From the above, it is clear that the central shaft 116, the first shaft 118, the second shaft 120 and the third shaft 122 are driven for rotation independently from one another by respective sets of motors 134, 140, 146 and 152. Furthermore, according to the invention, it is arranged that any two radially adjacent shafts are driven for rotation in opposite directions with respect to the axis X. That is, if the central shaft 116 is driven for rotation, for example, in the counterclockwise direction with respect to the axis X as viewed from the cutting member 116*b* thereof, then the first shaft 118 is driven for rotation in the clockwise direction with respective to the axis X, and the second shaft 120 is driven to rotate in the counterclockwise direction while the third shaft 122 is driven to rotate in the clockwise direction. In addition, according to the invention, the dimensions of the shafts 116, 118, 120 and 122 and the respective cutting members 116*b*, 118*b*, 120*b* and 122*b* thereof are determined in such a manner that a sum of cutting areas covered by the cutting members of the shafts rotating in one direction is substantially equal to a sum of cutting areas covered by the cutting members of the shafts rotating in the opposite direction.

As an example, a piling process using the cutter head 110 will be briefly described.

As shown in FIG. 5, a piling stand 166 is installed at the center of the piling position. A pile unit 168 and the cutter head 110 are suspended from the piling stand 166 through a guiding frame 170 thereof in such a manner that the cutter head 110 is received in the pile unit 168 except the cutting members 116*b*, 118*b*, 120*b* and 122*b* thereof. The cutter head 110 is then powered on in such a manner that any two radially adjacent transmission shafts and hence the cutting members thereof are driven to rotate in opposite directions for cutting the soil. The excavated soil is transported by the helical cutting blades 160 of the cutting member 118*b* and the helical cutting blades 164 of the cutting members 120*b* as well as passes through the openings 158 of the cutting member 118*b* and the openings 162 of the cutting member

120*b* to the center of the cutter head 110, and then is transported to a location behind the cutter head 110 by the screw rod type central shaft 116. A grab bucket 172 is suspended following the cutter head 110 from the piling stand 166 in order to remove the excavated soil. The pile unit 168 advances due to it's own weight at the same time with the cutting and the removal of the soil.

When the required depth is reached, the cuter head 110 is withdrawn. Since the arcuate segments and the wedge blocks of the cutting members 120*b* and 122*b* are stopped by the lower end of the pile unit 168, as mentioned above, they are left and crumble in the excavated pile hole when the annular portions of the cutting members 120*b* and 122*b* move with the other parts of the cutting head 110 being withdrawn, and thus can be taken out by the grab bucket 172. Then, concrete is cast to seal the bottom of the pile hole. Reinforced bars are placed into holes 174 (FIG. 7) previously formed in the pile unit 168. Then, cement slurry is cast into the holes 174 to bond the reinforced bars and the pile unit together.

With the cutter head having the above structure, since any two radially adjacent cutting members are driven to rotate in opposite directions rather than having all of the cutting members driven to rotate in a single direction, the deviation of the excavated tunnel or hole from the predetermined route is eliminated or at least minimized, the cutting efficiency is improved and any large single stone or the like which may be encountered during the cutting is effectively cut without inlaying onto the cutter head.

In addition, the reactions produced due to the cutting carried out by the cutting members rotating in one direction and the cutting carried out by the cutting members rotating in the opposite direction substantially cancel with each other. Hence, the body of the cutter head is in a balanced state.

Furthermore, during the excavation by the cutter head, the soil on the wall of the pile hole is supported by the pile unit and the synchronous removal of the excavated soil is carried out by the grab bucket, thereby significantly improving the working efficiency.

Next, a cutter head according to a third embodiment of the invention will be described by making reference to FIG. 13 which is a sectional view showing the cutter head applying in a shield machine, a tunnel boring machine, a pipe-jacking drive shield machine or the like for excavating in the horizontal direction.

Figure 13:
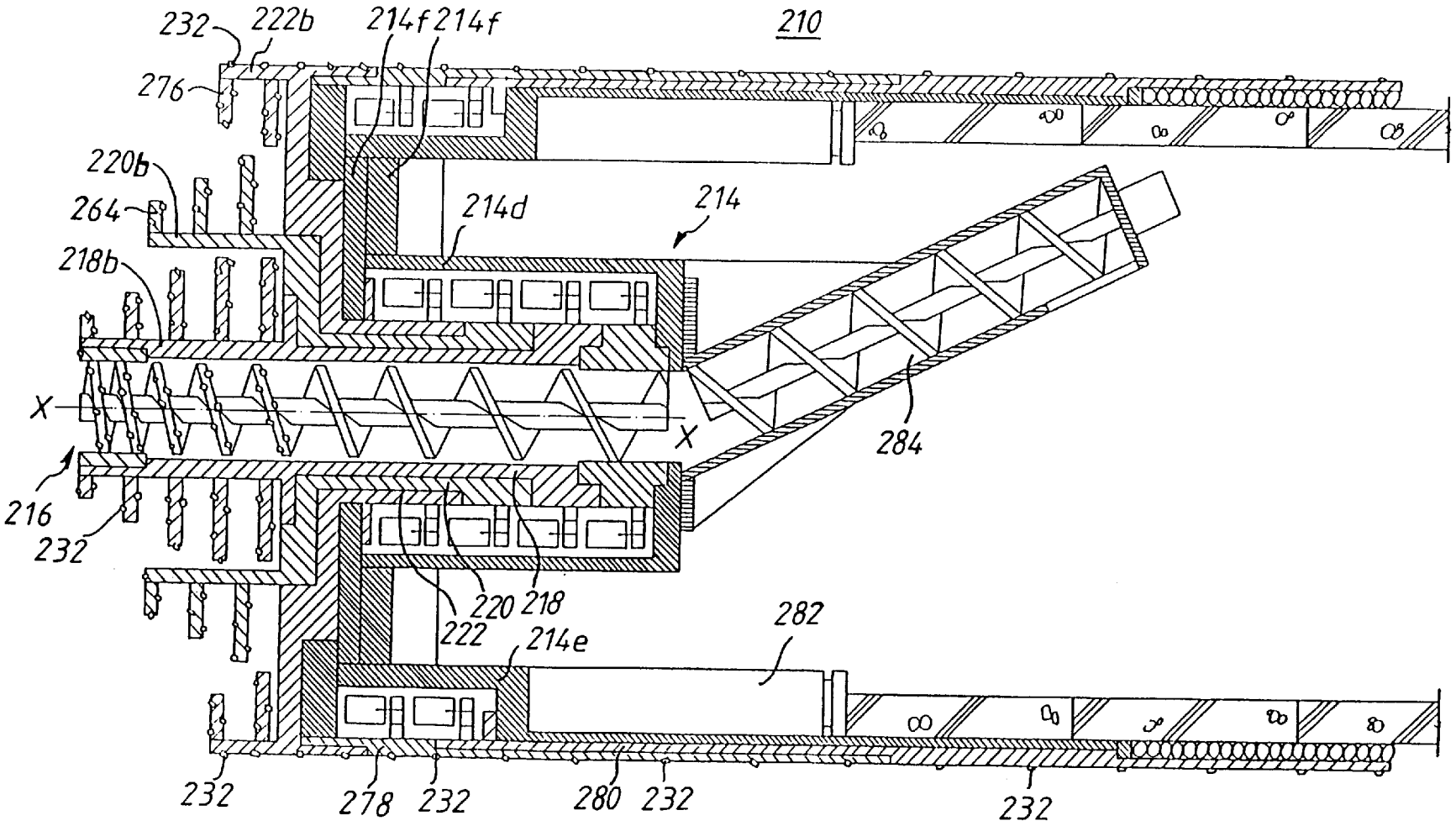
FIG. 13 is a sectional view showing a cutter head according to a third embodiment of the invention applying in a shield tunneling machine for excavating in a horizontal direction.

As shown in FIG. 13, the cutter head 210 according to the invention includes a fixed casing 214 having a center axis X, a central transmission shaft 216, a first tubular transmission shaft 218, a second tubular transmission shaft 220 and a third tubular transmission shaft 222. The casing 214 comprises a central portion 214*d* which is similar to the casings 14 and 114 described in the first and second embodiments, a peripheral annular portion 214*e* and a number of retainer rings 214*f* connecting the peripheral annular portion 214*e* to the central portion 214*d*. The central portion 214*d* of the casing 214 receives the shafts 216, 218, 220 and 222 coaxially about the center axis X.

The central transmission shaft (referred to as the central shaft hereinafter) 216 and the first tubular transmission shaft (referred to as the first shaft hereinafter) 218 of the cutter head 210 are substantially the same as the central shaft 116 and the first shaft 118, respectively, of the aforementioned cutter head 110 according to the second embodiment in terms of the structure thereof and the driving arrangement therefor. Hence, the description thereof is omitted here.

The second tubular transmission shaft (referred to as the second shaft hereinafter) 220 of the cutter head 210 is similar to the second shaft 120 of the cutter head 110 in terms of the structure thereof and the driving arrangement therefor except that a plurality of helical cutting blades 264 are disposed along and extending around the outer peripheral surface, instead of the inner peripheral surface, of the tubular cutting member of the second shaft 220.

The third tubular transmission shaft (referred to as the third shaft hereinafter) 222 of the cutter head 210 is similar to the third shaft 122 of the cutter head 110 in terms of the structure thereof and the driving arrangement therefor except that a plurality of helical cutting blades 276 are disposed along and extending around the inner peripheral surface of the tubular cutting member of the third shaft 222 and a plurality of cutters 232 are disposed on the helical cutting blades 276.

That is, similarly, the central shaft 216, the first shaft 218, the second shaft 220 and the third shaft 222 are driven for rotation independently from one another by respective sets of motors. Furthermore, according to the invention, it is arranged that any two radially adjacent shafts are driven for rotation in opposite directions with respect to the axis X. That is, if the central shaft 216 is driven for rotation, for example, in the counterclockwise direction with respect to the axis X as viewed from the cutting member thereof, then the first shaft 218 is driven for rotation in the clockwise direction with respective to the axis X, and the second shaft 220 is driven to rotate in the counterclockwise direction while the third shaft 222 is driven to rotate in the clockwise direction. In addition, according to the invention, the dimensions of the shafts 216, 218, 220 and 222 and the respective cutting members thereof are determined in such a manner that a sum of cutting areas covered by the cutting members of the shafts rotating in one direction is substantially equal to a sum of cutting areas covered by the cutting members of the shafts rotating in the opposite direction.

In addition, in this embodiment, two rotatable shields 278 and 280 are disposed behind the cutting members of the shafts to surround the peripheral annular portion 214*e* of the casing 214. Cutters 232 are provided on the outer peripheral surfaces of shields 278 and 280. The shields 278 and 280 are driven for rotation in the same manner as that of shafts. That is, each of the shields 278 and 280 is driven for rotation by a set of motors through an engagement of driving gears connected to respective output shafts of the motors with a ring gear mounted to the inner peripheral surface of the shields.

The operation of the cutter head 210 will be briefly described by making referring to FIG. 13. First, the cutter head 210 is powered on in such a manner that any two radially adjacent transmission shafts and hence the cutting members thereof are driven to rotate in opposite directions. Each of a number of push hydraulic cylinders 282 is actuated to produce and maintain a suitable pushing force on the cutter head 210 for the advancement thereof to cut the soil. The excavated soil is transported by the helical cutting blades of the cutting members 218*b*, 220*b* and 222*b* as well as passes through the openings of the cutting members 218*b* and 220*b* (not shown) to the center of the cutter head 210, and then is transported rearward (to the right of FIG. 13) by the central shaft 216.

A screw conveyor 284 is turned on for discharging the excavated soil. If the soil discharging speed of the screw conveyor 284 is lower than the soil delivering speed of the central shaft 216, then the soil accumulates at the end of the central shaft 216, and thus compaction and dehydration of soil occur. Therefore, the discharging speed of the screw conveyor 284 is adjusted for controlling the soil discharging amount and the moisture content of the soil.

The shields 278 and 280 are also driven to rotate in opposite directions. Thus, a friction between the cutter head 210 and the soil is reduced and hence it requires only a small pushing force to carry out the advancement of the cutter head 210. When the cutting of the cutter head 210 has to be stopped for various reasons, or the cutter head 210 is trapped by a reverse flow of the back-feed grout flowing thereto or by a geology improving slurry covering the head, the rotation of the shields 278 and 280 helps the cutter head 210 to escape. In addition, when the advancement of the cutter head 210 follows a curve, the soil of the excavated tunnel wall at one side of the cutter head 210 is compressed while the soil at the other side of the cutter head 210 is getting loose. The rotation of the shields 278 and 280 helps to cut the compressed soil by the cutters 232 disposed thereon and move the excavated soil from the compressed side to the loose side.

With the cutter head having the above structure, since any two radially adjacent cutting members are driven to rotate in opposite directions, any large single stone or the like which may be encountered during the cutting is effectively cut without inlaying onto the cutter head. Furthermore, the body of the cutter head is in a balanced state so that the direction control is easy and the phenomena of a zigzag course, up and down vibration, reverse rotation and the like are eliminated. In addition, the shields ensure that the cutter head would not be trapped and the excavated soil from the compressed side is moved to the loose side upon the change of the cutting direction of the cutter head.

Next, a cutter head according to a fourth embodiment of the invention will be described by making reference to FIG. 14 which is a sectional view showing the cutter head applying in a shield machine, a tunnel boring machine or the like for excavating a large, long-distance tunnel in the horizontal direction.

Figure 14:
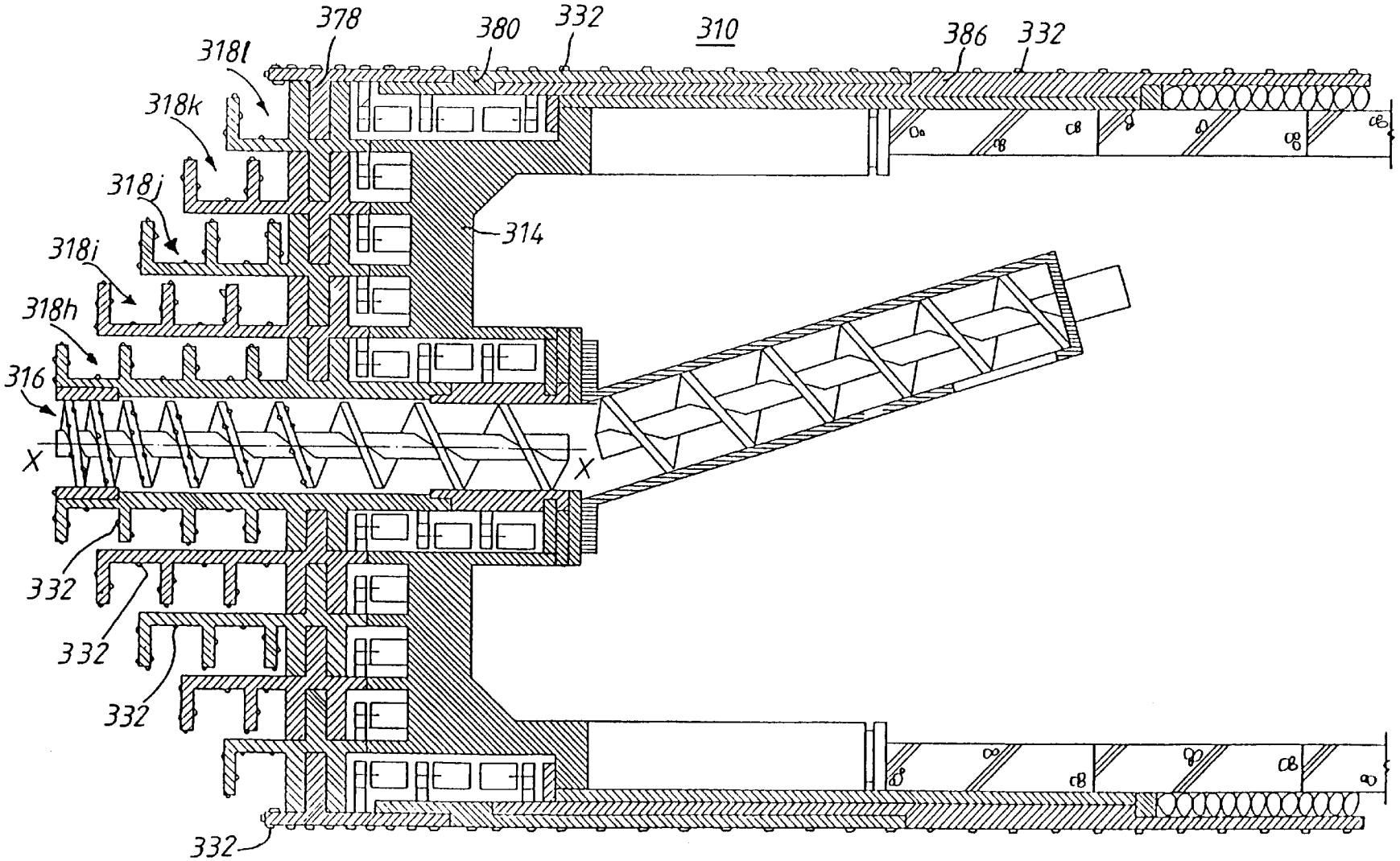
FIG. 14 is a sectional view showing a cutter head according to a fourth embodiment of the invention applying in a shield tunneling machine for excavating a large, long-distant tunnel.

As shown in FIG. 14, the cutter head 310 according to the fourth embodiment is different from the cutter head 210 according to the third embodiment in that the cutter head 310 includes a total of six transmission shafts, that is, one central screw rod type transmission shaft 316 and five tubular transmission shafts 318*h*–318*l*, coaxially disposed about an axis X of a casing 314. The structure of and the driving arrangement for each of the shafts are substantially the same as those of the various shafts described above in the previous embodiments. Hence, the description thereof is omitted here. However, note that the fixed casing 314 in this embodiment is modified in such a manner that several sets of motors for driving the corresponding shafts are disposed in sequence in the radial direction rather than in the axial direction of the casing 314, thereby reducing the dimension of the casing 314 in the axial direction thereof.

Similar to the third embodiment, three rotatable shields 378, 380 and 386 are disposed behind the cutting members of the shafts to surround the casing 314. Cutters 332 are provided on the outer peripheral surfaces of shields 378, 380 and 386. The shields 378, 380 and 386 are driven for rotation in the same manner as that of shafts. That is, each of the shields 378, 380 and 386 is driven for rotation by a set of motors through an engagement of driving gears connected to respective output shafts of the motors with a ring gear mounted to the inner peripheral surface of the shields. In addition, any two adjacent shields are driven to rotation in opposite directions with respect to the axis X.

The operation of the cutter head according to the fourth embodiment of the invention is substantially the same as that of the cutter head according to the third embodiment, and hence the description thereof is omitted here. The cutter head according to the fourth embodiment has the additional advantage that by modifying the casing in such a manner that several sets of motors for driving the corresponding shafts are disposed in sequence in the radial direction rather than in the axial direction of the casing, the number of the shafts and hence the cutting members can be increased to accommodate large scale tunneling works.

From the above description, it is clear that while the cutter heads according to various embodiments may be different in terms of their outward appearances, sizes and applicable conditions, they are all based on the very same technical idea. That is, a plurality of transmission shafts with respective cutting elements thereof are coaxially disposed and each of the shafts is independently provided with driving motors. In operation, the shafts are driven for rotation about a common axis independently with one another and any two radially adjacent shafts are driven to rotate in opposite directions so that the cutting surface is divided into a plurality of concentric annular portions to be cut by respective cutting elements, thereby achieving the effect that the reactions resulting from the cuttings carried out by respective cutting elements substantially cancel with one another.

While the present invention has been described above in detail in connection with its preferred embodiments, it is understood that the present invention is not limited to the details of the illustrated embodiments, but may have various changes, modifications and improvements, which may occur to those skilled in the art, without departing from the spirit and the scope of the present invention.

What is claimed is:

1. A cutter head comprising:

a fixed casing defining an axis of rotation;

a plurality of transmission shafts including a central transmission shaft and at least two tubular transmission shafts, each shaft having a first end fixedly connected with a cutting member and a second end;

means for rotatably mounting said plurality of transmission shafts at the second ends thereof to said casing and to one another coaxially about said axis of rotation with one shaft being disposed over an outer periphery of another shaft;

means for driving said plurality of transmission shafts in such a manner that the shafts are driven independently with one another and any two radially adjacent shafts are driven to rotate in a first direction and a second direction which is opposite to said first direction with respect to said axis of rotation, respectively; and such that the central transmission shaft includes a screw rod portion, the cutting member of the central transmission shaft is a tubular member having a closed end connected to the transmission shaft and an open end, and wherein a number of openings and at least one helical cutting blade are provided on a peripheral wall of the tubular cutting members of the at least two tubular transmission shafts, cutters being provided on an end face of the open end of the tubular member and on said at least one helical cutting blade.

2. The cutter head according to claim 1, wherein the means for rotatably mounting said plurality of transmission shafts at the second ends thereof to said casing and to one another includes a retainer portion, wherein the retainer portion for each of the shafts is removably connected to the second end of the shaft, and the means for driving said plurality of transmission shafts comprises for each shaft a motor mounted on said casing, a driving gear connected to an output shaft of the motor and a ring gear mounted on the transmission shaft and engaging with the driving gear.

3. A cutter head according to claim 1, further comprising at least one rotatable shield surrounding said casing, said at least one shield being driven for rotation by a motor through an engagement of a driving gear connected to an output shaft of the motor with a ring gear mounted on the shield and engaging with the driving gear.

4. The cutter head according to claim 1 in which the cutter head is powered on in such a manner that any two radially adjacent transmission shafts with respective cutting members thereof are driven to rotate in opposite directions for horizontally cutting soil, a hydraulic cylinder is actuated to produce a push force for the advancement of the cutter head, and a screw conveyor is turned on for discharging the cut soil with a discharging speed thereof being adjusted for controlling the soil discharging amount and the moisture content of the soil, wherein the cutter head is provided with shields which are driven in such a manner that any two adjacent shields rotate in opposite directions to cut the surrounding soil and to prevent the cutter head from being trapped.

* * * * *